US005320482A

United States Patent [19]

Palmer et al.

[11] Patent Number: 5,320,482

[45] Date of Patent: Jun. 14, 1994

[54] METHOD AND APPARATUS FOR REDUCING AXIAL THRUST IN CENTRIFUGAL PUMPS

[75] Inventors: Alan S. Palmer; John W. Henry, IV; John P. Kerr, all of Annapolis, Md.

[73] Assignee: The United States of America as represented by the Secretary of the Navy, Washington, D.C.

[21] Appl. No.: 947,593

[22] Filed: Sep. 21, 1992

[51] Int. Cl.[5] ..... F01D 3/00; F04D 29/04

[52] U.S. Cl. ..... 415/104; 415/174.3

[58] Field of Search ..... 415/170.1, 174.3, 131, 415/104

[56] References Cited

U.S. PATENT DOCUMENTS

| | | | |
|---|---|---|---|
| 4,451,213 | 5/1984 | Takei et al. | 415/55.5 |
| 4,586,877 | 5/1986 | Wantanabe et al. | 415/55.1 |
| 4,854,830 | 8/1989 | Kozawa et al. | 415/55.1 |
| 4,872,806 | 10/1989 | Yamada et al. | 415/55.5 |
| 5,096,396 | 3/1992 | Welch | 415/174.3 |
| 5,137,418 | 8/1992 | Siegartner | 415/55.1 |
| 5,163,810 | 11/1992 | Smith | 415/55.1 |

FOREIGN PATENT DOCUMENTS

| | | | |
|---|---|---|---|
| 655357 | 4/1986 | Switzerland | 415/104 |
| 693049 | 10/1979 | U.S.S.R. | 415/104 |
| 1150405 | 4/1985 | U.S.S.R. | 415/104 |
| 1275120 | 12/1986 | U.S.S.R. | 415/104 |

OTHER PUBLICATIONS

Stephanoff, A. J., "Centrifugal and Axial Flow Pumps", 2nd Edition, pp. 204–209 and 20–21.

*Primary Examiner*—Edward K. Look
*Assistant Examiner*—Michael S. Lee
*Attorney, Agent, or Firm*—Charles D. Miller; Gary G. Borda

[57] ABSTRACT

A control stator comprising a plurality of stationary vanes, ribs, or cavities is provided in a centrifugal pump having a shrouded impeller. The function of the control stator is to slow the swirl of fluid in the cavity between the casing and the impeller front shroud and thereby provide a very cost effective solution to the problem of excess axial thrust. The control stator is a simple, inexpensive non-rotating part that can be affixed in an existing space in the pump casing between the casing wall and the front shroud of the impeller.

10 Claims, 2 Drawing Sheets

METHOD AND APPARATUS FOR REDUCING AXIAL THRUST IN CENTRIFUGAL PUMPS

BACKGROUND OF THE INVENTION

This invention relates to centrifugal pumps of the kind having a shrouded impeller and a single entry eye, wherein the impeller is rotatable within a casing having an interior which is subjected to the pressure generated by the pump. In such centrifugal pumps, the impeller is subjected to an axial thrust because the effective axially-projected front area of the intake eye is unbalanced with respect to the fluid pressure upon it. Specifically, the mean intake pressure (or "suction"), acts on the upstream or front side of the impeller only. The fluid pressure within the casing acts on the axially projected area of the shroud to result in an axial thrust on the front of the impeller, while in the opposite direction, the fluid pressure acts on the back of the impeller over the whole of its projected area.

Axial thrust depends on the pressure distribution in the space between the impeller shrouds and the casing interior walls. The pressure distribution is in turn dependent on the clearances between the shroud and the casing walls. It is standard pump design practice to reduce the clearances between the back shroud and the adjacent casing wall and to increase the clearances between the front shroud and the adjacent casing wall in order to minimize axial thrust. To further protect the pump motor from the effects of axial thrust, it is also known to provide a suitable thrust bearing on the motor shaft. However, for those pumps in which more axial thrust is developed than can be safely carried away by a thrust bearing, or do not utilize standard type bearings (i.e., magnetic or journal bearings), additional modifications are required to reduce the thrust on the bearing.

In *Centrifugal and Axial Flow Pumps,* 2nd Edition, A. J. Stepanoff addresses two conventional methods of controlling axial thrust. In the first disclosed method, a balancing chamber behind the impeller is provided with a closely fitted set of wearing rings and suction pressure is admitted to this chamber either by drilling holes through the impeller back shroud into the eye or by providing a special channel connecting the balancing chamber to the suction nozzle. This technique, however, results in a doubling of pump leakage loss, and the magnitude of leakage loss increases steadily as the rings wear.

In the second disclosed method, radial ribs are used on the back shroud of the impeller to reduce the pressure in the space between the impeller and the pump casing. With these ribs closely fitted to the casing walls, the liquid rotates at approximately full impeller angular velocity, thereby reducing the pressure on the impeller back shroud. Although it is less expensive and more efficient than the first, the second method requires additional power to rotate the impeller.

Neither of the two conventional methods disclosed by Stepanoff are appropriate for pumps whose housing design parameters make it undesirable to include enough room to add backvanes or a large wear ring to the impeller. Further, because these techniques require specific clearances or additional space provisions in the casing, they can only be implemented at the design phase of the pump.

The present invention addresses the above noted axial thrust problem without the casing space requirements of the prior art solutions by employing a control stator having stationary vanes between the casing wall and the impeller front shroud. Because the vanes are non-rotating, balance and noise are not affected. The stator device provides a very cost effective solution to an excess axial thrust problem.

SUMMARY OF THE INVENTION

A centrifugal pump constructed in accordance with the present invention includes a casing having an axial fluid inlet. A rotating impeller having front and back shrouds is coupled to a rotating motor shaft and has an inlet area on its front surface opposite the fluid inlet of the casing. The casing has a first interior wall proximate the impeller front shroud and defining a first cavity therebetween and a second interior wall proximate the impeller back shroud and defining a second cavity therebetween. Control stator vanes increase fluid pressure in the first cavity and are positioned between the first interior wall and the front shroud.

The control stator includes mounting means for attaching the vanes to the casing. The vanes may be in the form of one or more elongated plates, one or more projections integrally formed on the surface of the first interior wall, or one or more elongated recesses in the surface of the first interior wall. If plates are used, they may be attached by welds, bolts, or other known fastening devices.

In one embodiment, the control stator comprises an annular disk for attaching the elongated plates to the first interior wall. The plates may be secured to the annular disk at circumferentially spaced intervals. Equidistant spacing of the plates is not required. The annular disk is secured to the first interior wall.

In another embodiment, the disk is omitted and the elongated plates are radially spaced and diverge in a common plane transverse to the central axis of motor shaft rotation. In this embodiment, the plates are individually connected by suitable fastening means such as bolts to the casing wall. The common plane may be spaced from the first interior wall.

In another embodiment, the stator vanes comprise one or more elongated projections integrally formed on the first interior wall. Where plural projections are used, they may be radially spaced and diverge from the axis of motor shaft rotation in a common plane. The common plane is defined by the surface of the first interior wall.

In yet another embodiment, the stator vanes comprise one or more elongated recesses integrally formed on the surface of the first interior wall. Where more than one recess is provided, they may be radially spaced and diverge from the axis of rotation in a common plane. The common plane is defined by the surface of the first interior wall.

A kit for reducing axial thrust in a centrifugal pump comprises the stationary control vanes and means for mounting them between the impeller front shroud and the adjacent interior wall of the casing. The control stator of the kit comprises a plurality of elongated plates and the means for mounting the plates comprises an annular disk, wherein the elongated plates are secured to the annular disk at circumferentially spaced intervals by suitable securing means. The elongated plates may be radially spaced and diverge in a common plane.

A method of reducing axial thrust in a centrifugal pump comprises providing pressure increasing vanes between the casing wall and the shrouded impeller. The vanes may be provided by mounting plates which are straight, curved, or radially concentric on the interior wall of the casing. Alternatively, the vanes may be provided as integrally formed recesses or projections on the casing wall.

DESCRIPTION OF THE INVENTION

Figure 1:
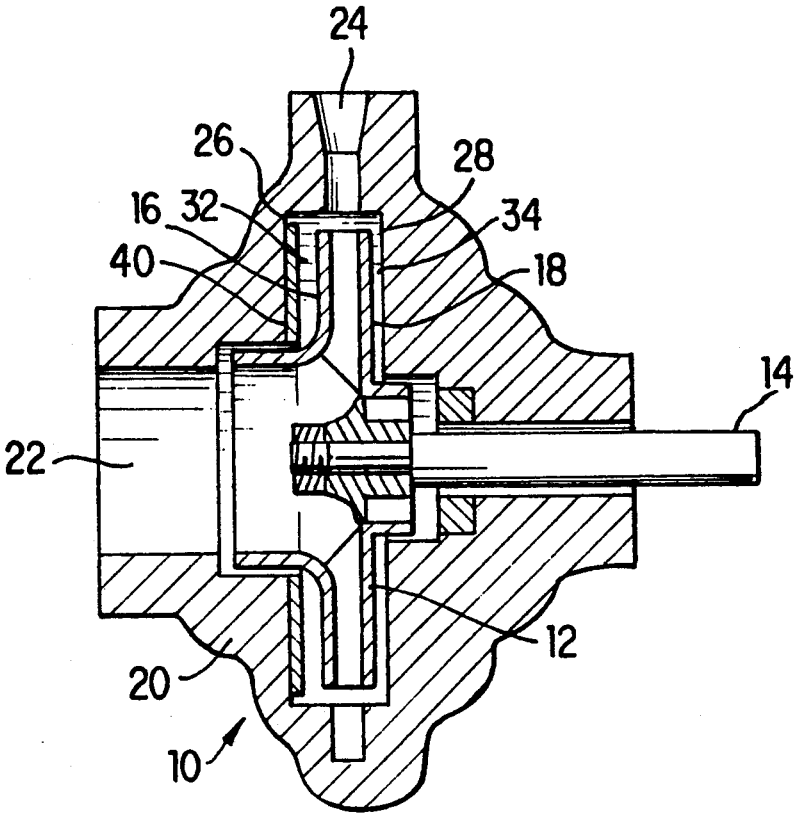
FIG. 1 is a schematic sectional view in the plane of the axis of rotation and of a diameter of the shrouded impeller of a centrifugal pump having a control stator installed in accordance with the present invention.

FIG. 1 shows a typical single stage, single suction centrifugal pump 10 consisting of an impeller 12 mounted on a motor shaft 14 and a casing 20 which houses the impeller and serves to port the pumped liquid into and away from the impeller. Impeller 12 is shrouded and includes a front shroud 16 and a back shroud 18. A first interior wall 26 of the casing faces the front shroud and a second interior wall 28 of the casing faces the rear shroud. The pump casing 20 includes a suction side opening 22 and a discharge side duct 24.

Pumped fluid fills the cavities 32 and 34 which are located between the impeller shrouds and casing walls 26 and 28, respectively. Fluid in these cavities tends to rotate at some fraction of impeller speed, the fraction varying as a function of cavity axial length and surface condition.

The rotating fluid in cavities 32 and 34 creates a vortex with a parabolic pressure profile varying as radius squared from discharge pressure at the impeller outer diameter to a lower pressure at the wear ring diameter. Since the impeller shroud area is relatively large, small differences in pressure (due to differences in vortex speed) between cavities 32 and 34 can result in large axial thrust forces on the impeller and on its supporting bearing system in the motor.

A stationary control stator 40 is positioned within cavity 32 between the interior casing wall 26 and the front shroud. The purpose of stator 40 is to reduce the vortex speed, thereby increasing the pressure in cavity 32 and hence neutralizing axial thrust by increasing the force tending to push the impeller back (away from the inlet).

Since the function of the stator 40 is to slow the swirl of fluid in the cavity between the casing and the impeller front shroud, it may take any number of forms, such as straight, radially extending, or curved vanes, ribs, or cavities. The vanes, ribs, or cavities may be cast or machined into the casing itself, may be secured individually to the casing walls, or may be attached as part of a plate which is then bolted or welded to the casing. It will be apparent that the axial thickness or depth of the vanes, ribs or cavities may be varied as well as the diameter of the stator elements to obtain the desired effect on the fluid. The number of vanes or elements can be varied and the material can be varied.

Figure 2:
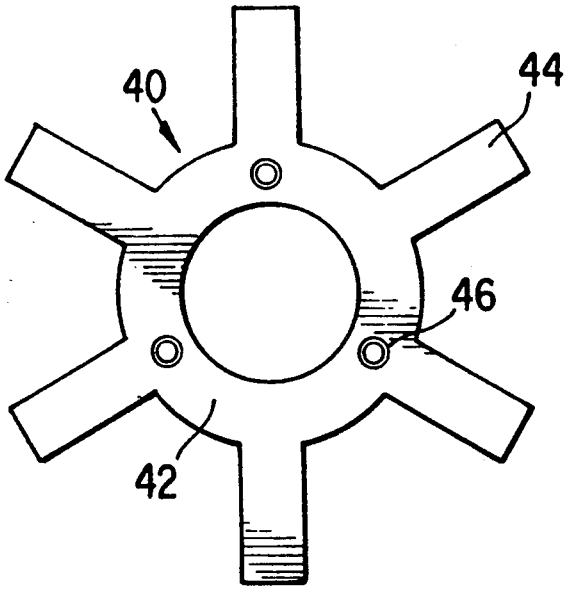
FIG. 2 is a plan view of a control stator in accordance with a first embodiment of the invention.

A first embodiment of the control stator is illustrated in FIG. 2. In accordance with the first embodiment, the stator 40 comprises an annular disk section 42 and six radially extending vanes 44 attached thereto. The vanes 44 may be integrally formed on the disk 42 or may be secured thereto by appropriate fastening means such as bolts, welds, or the like. Although any number and spacing of vanes may be used, they are preferably mounted at circumferentially equidistant points on annular disk 42. The disk 42 is attached by conventional fastening means to the interior wall 26. Holes 46 may be provided to facilitate the use of threaded bolts as attaching means.

Figure 3:
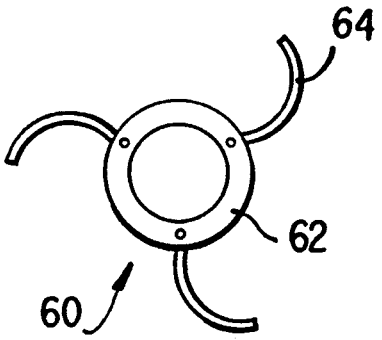
FIG. 3 is a plan view of a control stator in accordance with a second embodiment of the invention.

A second embodiment of the control stator is illustrated in FIG. 3. In accordance with this embodiment, the stator 60 comprises an annular disk section 62 and a plurality of curved vanes 64 extending from circumferentially equidistant points from annular disk 62. Although three vanes are illustrated, any number of curved vanes desired may be employed.

Figure 4:
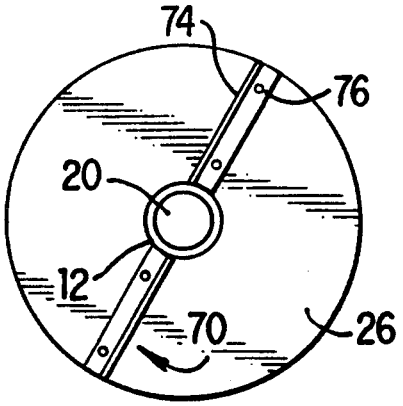
FIG. 4 is a plan view of a control stator in accordance with a third embodiment of the invention.

A third embodiment of the control stator is illustrated in FIG. 4. In accordance with this embodiment, the stator comprises a pair of individually mounted vanes 74. The vanes are secured to the interior wall 26 at opposite sides of the axis of rotation by conventional fastening means 76. Any number of additional vanes desired may be provided.

Figure 5:
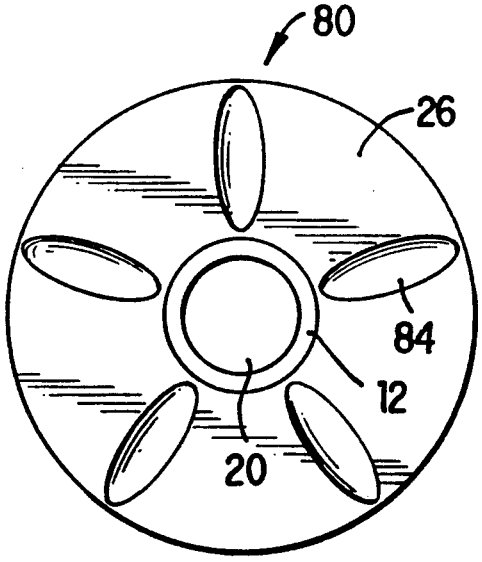
FIG. 5 is a plan view of a control stator in accordance with a fourth embodiment of the invention.

A fourth embodiment of the control stator is illustrated in FIG. 5. In accordance with this embodiment, the stator 80 comprises a plurality of elongated cavities 84 disposed in a radially spaced manner within the surface on interior wall 26. The cavities 84 may be cast or machined directly into casing interior wall 26.

Figure 6:
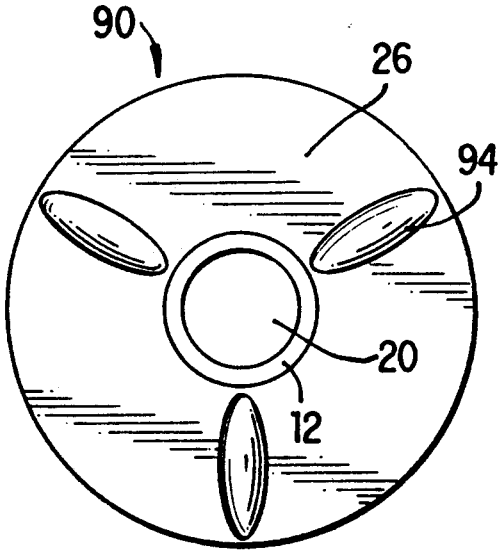
FIG. 6 is a plan view of a control stator in accordance with a fifth embodiment of the invention.

A fifth embodiment of the control stator is illustrated in FIG. 6. In accordance with this embodiment, the stator 90 comprises a plurality of projecting ribs 94 disposed in a radially spaced manner on the surface of interior wall 26. The ribs 94 may be cast or machined directly into interior wall 26.

Where it is desired to reduce or eliminate the problem of axial thrust in an existing pump, the control stator of the present invention can be provided in kit form. Such a kit would comprise stationary vanes as shown in FIGS. 2–4 and appropriate fastening such as bolts or welds for securing the vanes to the casing wall facing the front shroud of the impeller.

The specific illustrations and corresponding description are used for the purposes of disclosure only, and are not intended to impose any unnecessary limitations on the claims.

What is claimed is:

1. A centrifugal pump of the type having a casing, an axial fluid inlet in said casing, a rotating shaft, a rotatable impeller within said casing, said impeller being mounted on said shaft and having an inlet area on its front surface opposite said fluid inlet of the casing, an impeller front shroud, and an impeller back shroud, said casing comprising a first interior wall proximate said impeller front shroud and defining a first cavity therebetween and a second interior wall proximate said impeller back shroud and defining a second cavity therebetween, wherein the improvement comprises:

means for increasing fluid pressure in said first cavity, said fluid pressure increasing means comprising stationary vane means, said stationary vane means being positioned between said first interior wall and said front shroud to reduce a fluid vortex speed and thus increase the fluid pressure in said first cavity whereby axial thrust on said impeller is reduced; and mounting means for attaching said stationary vane means to said first interior wall of said casing, said mounting means comprising an annular disk, said stationary vane means being secured to said annular disk at circumferentially spaced intervals.

2. The apparatus of claim 1, wherein said vane means comprises an elongated plate.

3. The apparatus of claim 1, wherein said vane means comprises a plurality of elongated plates.

4. The apparatus of claim 3 wherein said elongated plates are radially spaced and diverge in a common plane from a central axis.

5. The apparatus of claim 4 wherein said elongated plates diverge in a plane parallel to said first interior wall.

6. A kit for reducing axial thrust in a centrifugal pump of the type having an impeller rotatable within a casing, said casing having an axial fluid inlet in a first interior wall, said impeller having a front shroud and a back shroud and being disposed between said first interior wall and a second interior wall of said casing, said kit comprising:

vane means, wherein said vane means comprises a plurality of elongated plates; and means for mounting said vane means in a stationary position between said front shroud and said casing wherein said means for mounting said vane means comprises an annular disk, said elongated plates being secured to said annular disk at circumferentially spaced intervals whereby fluid pressure between said front shroud and said casing is increased.

7. The kit of claim 6 wherein said elongated plates are radially spaced and diverge in a common plane.

8. The kit of claim 6 wherein said plurality of elongated plates consists of three plates spaced equidistantly from each other on said annular disk.

9. The kit of claim 6 wherein said plurality of elongated plates consists of six plates spaced equidistantly from each other.

10. A method of reducing axial thrust in a centrifugal pump of the type having a casing an axial inlet in a first interior wall of said casing and shrouded impeller rotatable between said first interior wall and a second interior wall of said casing, said method comprising the steps of:

providing a fluid pressure increasing means between said first interior wall and said shrouded impeller to reduce a fluid vortex speed and thus increase the fluid pressure therebetween, wherein said fluid pressure increasing means comprises stationary vane means; and attaching a means for mounting said stationary vane means to said first interior wall of said casing wherein said means for mounting said stationary vane means comprises an annular disk, said stationary vane means being secured to said annular disk at circumferentially spaced intervals.

* * * * *